US006845544B2

(12) United States Patent
Hofer

(10) Patent No.: US 6,845,544 B2
(45) Date of Patent: Jan. 25, 2005

(54) HINGE FOR FURNITURE

(75) Inventor: Claus Hofer, Fussach (AT)

(73) Assignee: Julius Blum Gesellschaft m.b.H., Hochst (AT)

( * ) Notice: Subject to any disclaimer, the term of this patent is extended or adjusted under 35 U.S.C. 154(b) by 28 days.

(21) Appl. No.: 10/298,067

(22) Filed: Nov. 18, 2002

(65) Prior Publication Data

US 2003/0093877 A1 May 22, 2003

(30) Foreign Application Priority Data

Nov. 19, 2001 (AT) ..... GM 889/2001 U

(51) Int. Cl.[7] ..... E05D 7/04
(52) U.S. Cl. ..... 16/246; 16/242; 16/245
(58) Field of Search ..... 16/236, 240, 242, 16/245, 246, 382

(56) References Cited

U.S. PATENT DOCUMENTS 3,890,670 A 6/1975 Sewing et al.
3,940,829 A * 3/1976 Grunert et al. ..... 16/366
4,359,802 A * 11/1982 Rock ..... 16/238
4,412,366 A 11/1983 Röck et al.
5,920,958 A * 7/1999 Domenig et al. ..... 16/237
6,148,479 A * 11/2000 Lin ..... 16/258
6,463,626 B1 * 10/2002 Ferrari et al. ..... 16/236
6,470,531 B2 * 10/2002 Domenig et al. ..... 16/240
6,643,895 B1 * 11/2003 Domenig et al. ..... 16/238
6,647,591 B1 * 11/2003 Domenig et al. ..... 16/242

FOREIGN PATENT DOCUMENTS

DE 2815816 10/1979
DE 3020158 12/1980
DE 10015805 A1 9/2000
GB 2 348 241 * 9/2000

* cited by examiner

*Primary Examiner*—Gary S. Hartmann
(74) *Attorney, Agent, or Firm*—Wenderoth, Lind & Ponack, L.L.P.

(57) ABSTRACT

A hinge for articulating a door to a frame of a piece of furniture includes a base plate mounted on the frame. The base plate bears a hinge arm to which a hinge boss is articulated by a hinge pin. An intermediate member is positioned between the hinge arm and the base plate. The base plate, the intermediate member and the hinge arm are connected by a pin. The intermediate member is tiltable with respect to the base plate by virtue of an adjustment screw, and the hinge arm is linearly moveable on the intermediate member in a direction of the depth of the piece of furniture.

20 Claims, 3 Drawing Sheets

HINGE FOR FURNITURE

BACKGROUND OF THE INVENTION

The invention relates to a hinge having a hinge boss to be mounted on a door and a hinge arm which may be secured to a frame of an article of furniture. The hinge arm is mounted on a frame by virtue of a base plate that is fixed on the frame by at least one fixing screw or dowel. An intermediate member is positioned between the hinge arm and the base plate.

In modern furniture constructions so called door frames are in increasingly wide spread use, such frames being the stable part which bears the hinges for a door, since actual side walls of a carcass of an item of furniture being made of thinner material. This provides an advantage in that either the total costs of the item of furniture can be reduced, since its side walls may be extremely thin, or materials of higher quality which are consequently more attractive, can be selected for the side walls without the furniture being more expensive than conventionally manufactured furniture.

Such a hinge is known from U.S. Pat. No. 5,930,866. This hinge is provided with an eccentric by which the position of the hinge arm with respect to the base plate can be adjusted.

SUMMARY OF THE INVENTION

An object of the invention is to improve such a hinge making it easier to mount to a frame, and to make an easier adjustment of the hinge arm, and therefore of the door with respect to the frame, possible.

The object according to the invention is achieved by the fact that the base plate, the intermediate member and the hinge arm are connected by a pin, whereby the intermediate part is tiltable about the pin with respect to the base plate by virtue of an adjustment screw and the hinge arm is slideable on the intermediate member in a direction transverse to the pin.

When mounting the hinge to the frame of an article of furniture, the base plate, the intermediate part and the hinge arm are an assembly. This assembly is held to the frame and fastened by the fixing screw. It is not necessary that the base plate is first screwed to the frame and that the intermediate part and the hinge arm are later mounted on the base plate.

In an embodiment of the invention the pin protrudes though circular holes in the base plate and the intermediate member and through slots in the hinge arm.

According to a further embodiment of the invention, a good hold of the hinge arm on the intermediate member is achieved by the fact that the hinge arm and the intermediate member both have U-shaped profile, with the hinge arm being mounted on the intermediate member, and in that the side webs of the hinge arm are provided with inwardly directed projections which are slideable on the side webs of the intermediate member.

To provide an easier adjustment of the position of the hinge arm in a direction of depth of a piece of furniture, an eccentric is mounted on the intermediate member, with the eccentric having a cam which is situated in an elongated hole of the hinge arm.

BRIEF DESCRIPTION OF THE DRAWINGS

An exemplary embodiment of the invention is described in detail below with reference to the enclosed drawings wherein.

DETAILLED DESCRIPTION OF THE PREFERRED EMBODIMENTS

Figure 1:
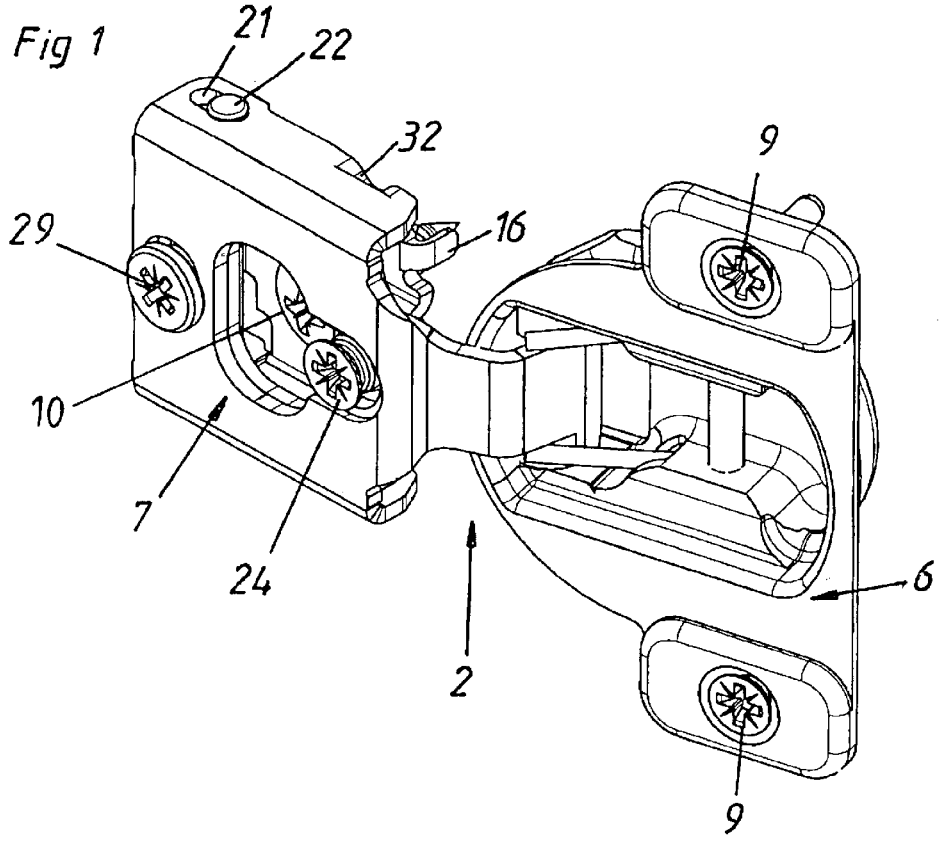
FIG. 1 is a perspective view of a hinge according to the invention.
Figure 3:
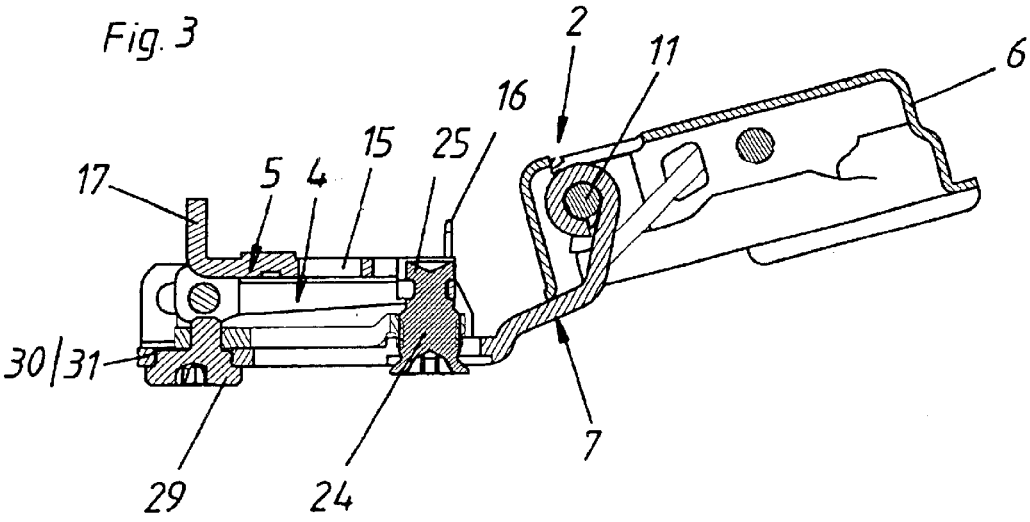
FIG. 3 is a section of a hinge according to the invention taken orthogonally to a hinge axis.
Figure 2:
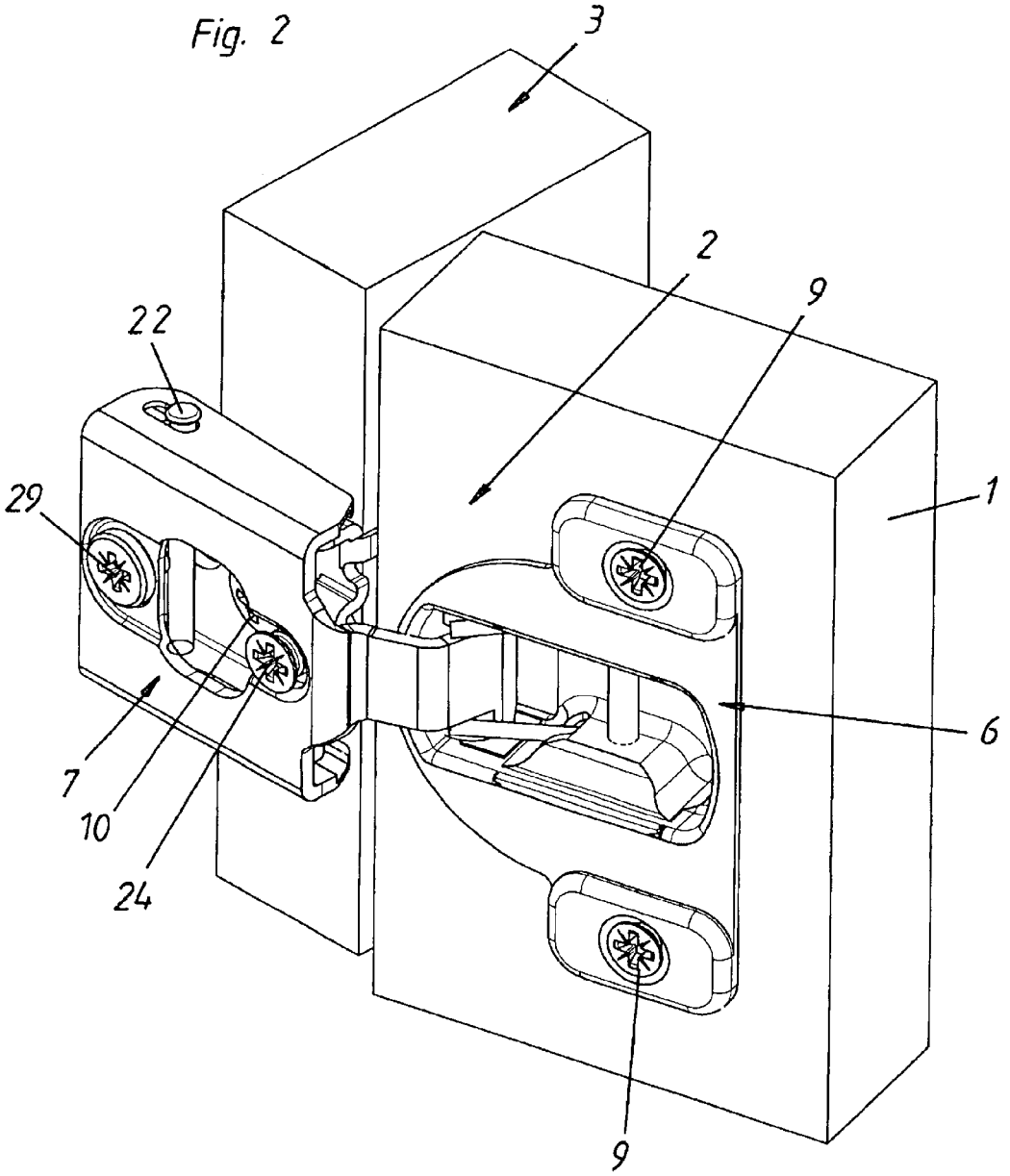
FIG. 2 is a perspective view of a hinge according to the invention in a mounted position, with sections of a frame and of a door being shown.
Figure 4:
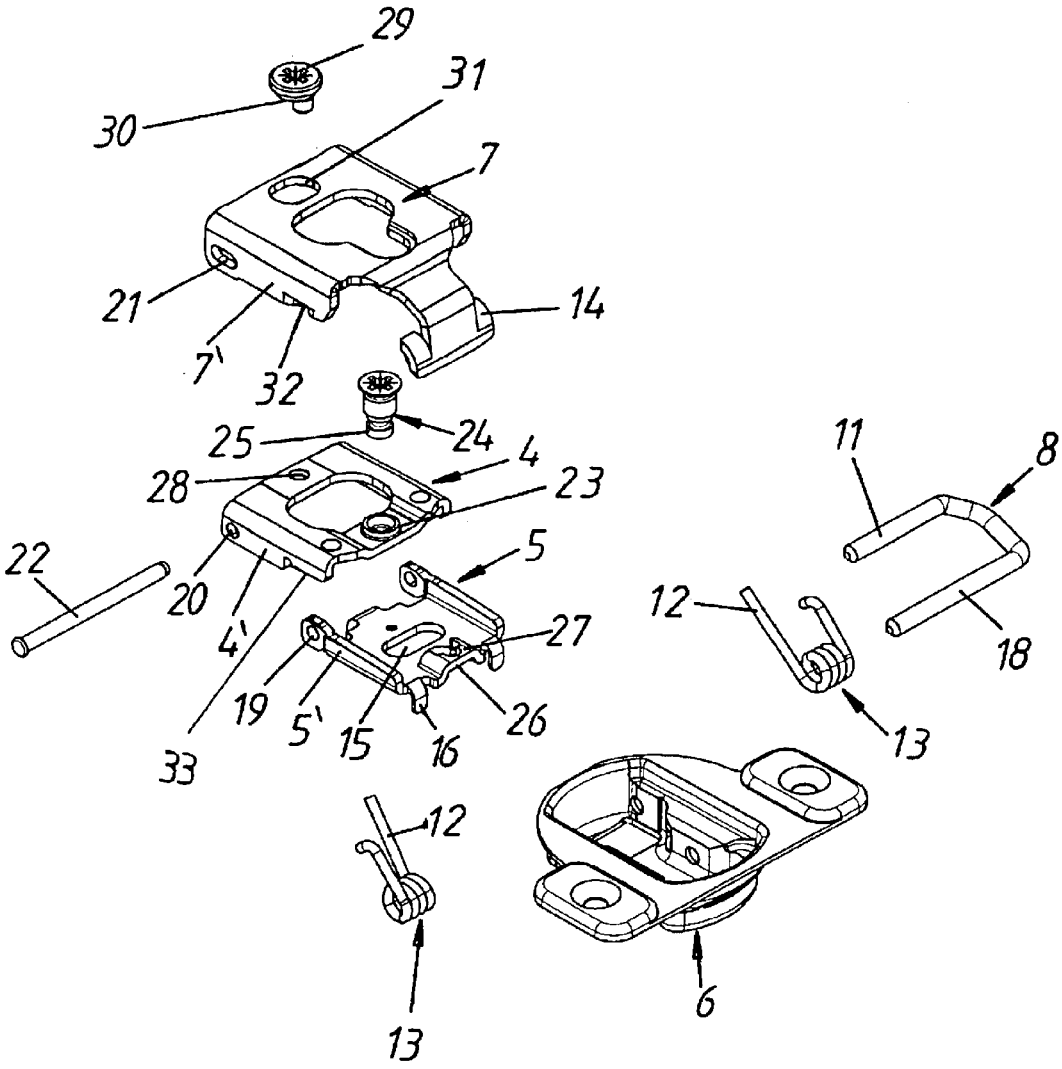
FIG. 4 is an exploded perspective view of parts of the hinge.

In FIG. 2 a door 1 is shown in an open position. A hinge 2 connects the door 1 to a frame 3 of a piece of furniture, e.g. a cabinet.

The hinge 2 includes a base plate 5, an intermediate member 4, a hinge arm 7 and a hinge boss 6 which is mounted on the door 1. The hinge boss 6 is hinged to the hinge arm 7 by hinge pin 11. The hinge pin 11 is part of bracket 8 in U-shaped.

The hinge boss 6 is set into a drilled hole in the door 1 and screwed onto the door 1 by screws 9.

Situated at the bottom of the hinge boss 6 is a retaining mechanism in which springs 13 of a closing mechanism are mounted. Legs 12 of springs 13 press on cam members 14 which are provided at the free end of the hinge arm 7. By virtue of the springs 13 with the legs 12, the hinge boss 6 is held in its closed position or, if an angle between the door 1 and a closing plane is very small, is pulled into the closed position.

The base plate 5 is mounted directly on the frame 3 of the piece of furniture, and is secured to the frame 3 by a fixing screw 10 which projects through an elongated hole 15 in the base plate 5. The base plate 5 has, at its side facing the door 1, two bearing webs 16 which in a fitted position rest against the front of the door 1. At a rear side of the frame 3 the base plate 5 is provided with a flap 17 which rests against a back of frame 3.

Over the length of the elongated hole 15 a position of the hinge can be adjusted on the piece of furniture in a vertical direction.

The base plate 5 as well as the intermediate member 4 and the hinge arm 7 have U-shaped profiles. Side webs 5' of the base plate 5 are directed towards the intermediate member 4. Side webs 4' of the intermediate member 4 and the side webs 7' of the hinge arm 7 are directed towards the base plate 5. The side webs 5' of the base plate 5 are provided with circular holes 19 which can be drilled holes or punched holes. The side webs 4' of the intermediate member 4 are provided with circular holes 20 which also can be drilled holes or punched holes. The side webs 7' of the hinge arm 7 are provided with slots 21. The intermediate member 4 and the hinge arm 7 are mounted on the base plate 5 by virtue of a pin 22 which protrudes through the circular holes 19, 20 and the slots 21.

The intermediate part 4 is provided with a female screw thread 23 in which an adjustment screw 24 is mounted. The adjustment screw 24 is provided with a screw head 25 which is anchored in a bridge 26 of the base plate 5. The bridge 26, which is punched from the base plate 5, is provided with an open slot 27 in which the adjustment screw 24 is held. An eccentric 29 is mounted in the rear hole 28 of the intermediate member 4. The cam 30 of the eccentric 29 is positioned within an elongated hole 31 of the hinge arm 7.

Turning the adjustment screw 24 causes the hinge arm 7 and the intermediate member 4 to be tilted around the pin 22.

Thereby at this placement of the hinge pin 11 in a direction of door overlay, i.e. in a direction parallel to the door in the closed position is achieved.

By turning the eccentric 29, the hinge arm 7 is displaced on the intermediate member 4 in the direction of the depth of the piece of furniture. The hinge arm 7 can be moved over a length of the slots 21.

Height adjustment of the door 1 is achieved by loosening the fixing screw 10 and moving the hole hinge in its entirety over a length of the elongated hole 15. When the hinge 2 is in its correct position the fixing screw 10 is tightened.

The side webs 7' of the hinge arm 7 are provided with inwardly directed projections 32 which are punched from the side webs 7'. The projections 32, which are positioned underneath the side webs 4' of the intermediate member 4, together with the pin 22 provide a guiding device for linear movement of the hinge arm 7.

The side webs 4' of the intermediate member 4 are provided with L-shaped cut outs 33. The projections 32 are situated within these cut outs 33.

What is claimed is:

1. A hinge for articulating a door relative to a frame of an article of furniture so as to enable movement of the door between open and closed positions with respect to the frame, said hinge comprising:

a hinge boss to be mounted on the door;

a base plate to be mounted on the frame by at least one fixing screw; and an intermediate member and a hinge arm mounted on said base plate, said hinge arm having an end hinged to said hinge boss;

wherein said base plate said, intermediate member and said hinge arm are interconnected by a pin such that said intermediate member is tiltable about said pin with respect to said base plate by virtue of an adjustment screw, and said hinge arm is slideable on said intermediate member in a direction transverse to said pin.

2. The hinge according to claim 1, wherein said pin protrudes through circular holes in said base plate and said intermediate member and through slots in said hinge arm.

3. The hinge according to claim 2, wherein said hinge arm and said intermediate member have U-shaped profiles, respectively, and are mounted on said base plate by virtue of said pin which protrudes through side webs defining said U-shaped profiles.

4. The hinge according to claim 1, wherein said adjustment screw is mounted in a female thread in said intermediate member and is provided with a screw head which is anchored in said base plate.

5. The hinge according to claim 4, wherein said adjustment screw protrudes through a slot which is provided in a bridge of said base plate on a side of said intermediate member.

6. The hinge according to claim 1, wherein an eccentric is mounted in said intermediate member, said eccentric having a cam which is situated in an elongated hole of hinge arm.

7. The hinge according to claim 3, wherein said side webs defining said U-shaped profile of said hinge arm are provided with inwardly directed projections which are slideable on rims of said side webs defining said U-shaped profile of said intermediate member.

8. The hinge according to claim 7, wherein said side webs defining said U-shaped profile of said intermediate member are provided with cut outs, with said projections of said hinge arm being situated within said cut outs.

9. The hinge according to claim 1, wherein said pin passes through said base plate, said intermediate member and said hinge arm so as to interconnect said base plate, said intermediate member and said hinge arm.

10. The hinge according to claim 9, wherein said pin protrudes through circular holes in said base plate and said intermediate member and through slots in said hinge arm.

11. The hinge according to claim 10, wherein said hinge arm and said intermediate member have U-shaped profiles, respectively, and are mounted on said base plate by virtue of said pin which protrudes through side webs defining said U-shaped profiles.

12. The hinge according to claim 9, wherein said adjustment screw is mounted in a female thread in said intermediate member and is provided with a screw head which is anchored in said base plate.

13. The hinge according to claim 12, wherein said adjustment screw protrudes through a slot which is provided in a bridge of said base plate on a side of said intermediate member.

14. The hinge according to claim 9, wherein an eccentric is mounted in said intermediate member, said eccentric having a cam which is situated in an elongated hole of said hinge arm.

15. The hinge according to claim 11, wherein said side webs defining said U-shaped profile of said hinge arm are provided with inwardly directed projections which are slideable on rims of said side webs defining said U-shaped profile of said intermediate member.

16. The hinge according to claim 15, wherein said side webs defining said U-shaped profile of said intermediate member are provided with cut outs, with said projections of said hinge arm being situated within said cut outs.

17. The hinge according to claim 1, wherein said hinge arm and said intermediate member have U-shaped profiles, respectively, and are mounted on said base plate by virtue of said pin which protrudes through side webs defining said U-shaped profiles.

18. The hinge according to claim 1, wherein said adjustment screw protrudes through a slot which is provided in a bridge of said base plate on a side of said intermediate member.

19. The hinge according to claim 17, wherein said side webs defining said U-shaped profile of said hinge arm are provided with inwardly directed projections which are slideable on rims of said side webs defining said U-shaped profile of said intermediate member.

20. The hinge according to claim 19, wherein said side webs defining said U-shaped profile of said intermediate member are provided with cut outs, with said projections of said hinge arm being situated within said cut outs.

* * * * *